US006000848A

United States Patent [19]

Massioui

[11] Patent Number: 6,000,848

[45] Date of Patent: Dec. 14, 1999

[54] FLUID PACKAGE WITH CLOSURE

[76] Inventor: Farid El Massioui, 6 Rue Des Nenupahres, Briis sous Forges 91640, France

[21] Appl. No.: 08/889,189

[22] Filed: Jul. 8, 1997

[51] Int. Cl.[6] ..... B65D 33/16

[52] U.S. Cl. ..... 383/80; 215/306; 222/464.1; 383/104; 383/904; 383/906

[58] Field of Search ..... 383/80, 96, 104, 383/127, 904, 906; 222/464.1, 543, 568; 239/24.33; 205/306; 220/375

[56] References Cited

U.S. PATENT DOCUMENTS

| | | | |
|---|---|---|---|
| 554,941 | 2/1896 | Lines | 222/568 |
| 3,050,218 | 8/1962 | Harvey | 222/568 X |
| 3,058,633 | 10/1962 | Muhlhoff | 222/568 |
| 3,235,117 | 2/1966 | Mason, Jr. | 215/306 X |
| 3,416,688 | 12/1968 | Fanning | 215/306 |
| 4,054,221 | 10/1977 | Glover | 214/306 X |
| 4,284,213 | 8/1981 | Lee | 222/568 X |
| 4,583,668 | 4/1986 | Maynard, Jr. | 222/568 X |
| 4,669,124 | 5/1987 | Kimura | 383/80 |
| 4,732,299 | 3/1988 | Hoyt | 383/906 X |
| 5,725,121 | 3/1998 | Gianpaolo | 215/306 X |

FOREIGN PATENT DOCUMENTS

| | | | |
|---|---|---|---|
| 753223 | 10/1933 | France | 383/96 |
| 5-229566 | 9/1993 | Japan | 383/906 |

*Primary Examiner*—Stephen P. Garbe
*Attorney, Agent, or Firm*—Marc C. Jacobs, Esq.

[57] ABSTRACT

A closure for a self-standing pouch designed to hold fluid, which closure includes a fitment, having a base and either an integral or removable stem, which stem carries an integrated cap. The closure may also include a straw that extends downward into the fluid and above the stem or at least a mouthpiece. A straw like member in place of a straw can be integral to the fitment, or threadable or otherwise attachable thereto. The fitment aspect may be one piece or two as noted, and if two, is adapted to permit the refilling of the pouch as may be desired. The closure may be placed at various locations on a fluid containing pouch.

19 Claims, 5 Drawing Sheets

FLUID PACKAGE WITH CLOSURE

FIELD OF THE INVENTION

This patent application relates to pouches used as packaging for fluids preferably for soft drinks, which pouches have a closure for fluid access included therewith. More particularly, this invention is an improvement to the DOY-PAK™ stand-up pouch.

BACKGROUND OF THE INVENTION

It is known that Louis Doyen of Lyon, France, alone and with others has obtained a series of patents pertaining to the manufacture of plastic stand-up pouches and the pouches themselves, which are used primarily for beverages. In the U.S.A., one well known brand of product is the Capri Sun® line of juice drinks made and distributed by Kraft Inc. The products sold under this trademark are individual servings of a juice drink in a sealed pouch. A plastic wrapped pointed straw is removably adhered to the package of juice. In order to access the contents of the pouch, one unwraps the straw, and carefully pierces the packaging at a predefined location, wherein the outer layer of the multilayer package has already been die cut utilizing the pointed end of the straw. Usually the tip of the straw will pierce the "exposed" aluminum foil and the plastic layer there beneath. Attempts to pierce the package at other locations than the pre-defined one are usually not successful due to the tough outer layer of plastic employed for these pouches.

The technology of these pouches is disclosed and claimed in the following U.S. Patents:

| | | |
|---|---|---|
| L. Doyen et al | 3,192,095 | 6/29/65 |
| Boquet & Doyen | 4,023,700 | 5/17/77 |
| Aquetant & Doyen | 4,010,786 | 3/8/77 |
| Doyen & Doyen | 3,935,993 | 2/3/76 |
| Doyen & Doyen | 3,637,133 | 2/25/72 |
| Doyen | 3,583,132 | 6/8/71 |
| Doyen | 3,514,061 | 5/26/70 |
| Doyen et al | 3,380,646 | 4/30/68 |

Of course other people have made advances in the pouch and closure art as well. Thus applicant is also aware of U.S. Patents issued to:

| | | |
|---|---|---|
| Weikert | 3,783,920 | 1/6/74 |
| Murray | 4,658,434 | 4/14/87 |
| Hoyt | 4,732,299 | 3/22/88 |
| Chatourel | 5,094,367 | 3/10/92 |

None of the references known to applicant, either alone or in combination, anticipate the claims herein or render them obvious.

It is an object therefor of this invention to provide a new closure for self-standing pouch containers.

It is another object to provide a closure for pouch type containers that can be heat sealed into position.

It is a further object to provide a fitment portion of a closure for a pouch such that the pouch can be refilled if desired.

It is a yet further object to provide both one and two piece fitments that incorporate a straw thereon.

It is a still further object to provide a closure for a pouch which can be positioned at various locations on the pouch, including top, side, and angularly between the top and side.

It is an additional object to provide a pouch closure with an integrated cap.

It is a yet further object to provide a pouch closure that includes a straw and which closure includes an integrated cover over the straw portion thereof.

Other objects of the invention will in part be obvious and will in part appear hereinafter.

The invention accordingly comprises the device possessing the features, properties, and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

A closure for a self-standing pouch designed to hold fluid, which closure includes a fitment, having a base and either an integral or removable stem, which stem carries an integrated cap and either a mouthpiece or a portion of a straw. The fitment aspect may be one piece or two, that is, the stem can be either integrally formed as part of the base, one piece; or the stem can be threadedly engageable with the base, two piece. If two, the fitment is thus adapted to permit the refilling of the pouch as may be desired.

DESCRIPTION OF THE PREFERRED EMBODIMENT

In FIGS. 1–4 the first embodiment of this invention is seen. As has been pointed out previously, the concept of forming a stand-up pouch for holding drinkable fluids such as juice is well known. Such drinks are available in the U.S.A. and elsewhere under one or more brand names directed at the youth market. These pouches suffer from the fact that the access to the contents is obtained by way of an externally mounted pointed straw which is removably adhered to the package's rear face, removed from its wrapper and then used to puncture an area of the obverse face of the package such that the contents can be sucked out. See FIGS. 14 and 15, which show the wrapped pointed straw and the defined point of insertion which lacks the thick plastic layer over the film inner packaging layer there beneath.

Figure 1:
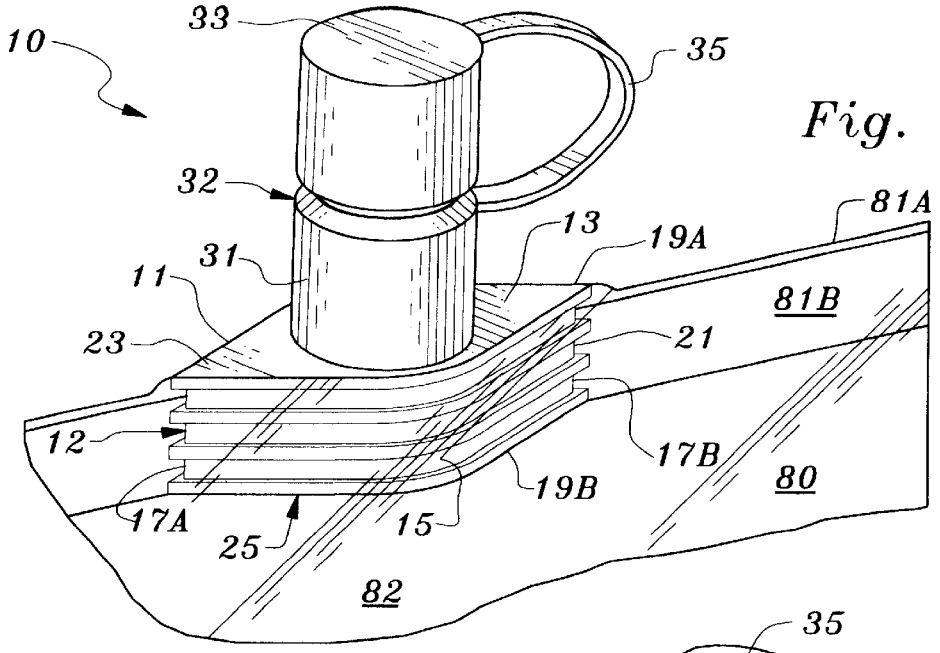
FIG. 1 is a perspective view of the first embodiment of the invention showing a closure comprising a one piece fitment horizontally mounted with the cap in place and no straw.

In FIG. 1 a typical self-supporting pouch structure 80 having a bag portion 82 disposed beneath a heat or sonic sealable upper edge 81, formed of two members 81A and 81B. Members 81A and B are sealed around a closure 10 which forms the subject matter of this invention. Thus closure 10 comprises a one piece fitment 11 having a boat shaped base 12, having a point at each end 17A, 17B, with the two sides 13, 15 depending linearly outwardly from a first point, to a maximum amount, then curving around and then inwardly again a similar amount toward and to the opposite point. Base 12 also has an upper surface 23 and a lower surface 25. The invention is deemed a "closure" because in a sense it closes off the pouch which is heat sealed or otherwise sealed against it. The base includes integrated uniform outward extending ribs 19A and 19B which extend linearly from the upper and lower surfaces respectively, and at least one intermediate rib 21 spaced from the top and bottom ribs. A stem 31 is mounted to the fitment 11, and said stem is closed off by a cover 32 comprising a cap 33 and a flexible handle 35 attached to both the stem 31 and cap 33. Stem 31 can be formed as an integrally molded member as here, or may be a separate member as will be discussed with respect to a second embodiment involving a two piece fitment.

Figure 2:
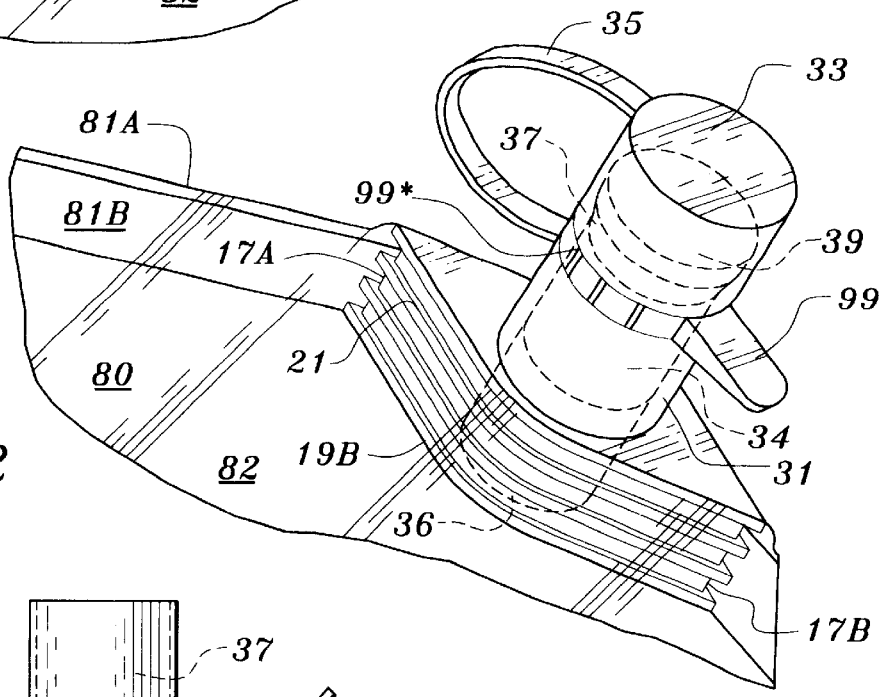
FIG. 2 is a similar view to FIG. 1 wherein the fitment is angularly disposed on a pouch.

The reader's attention is now directed to FIG. 2. Here it is seen that the stem 31 has a central throughbore 34 which communicates with a preferably similar cross section throughbore 36 of the base 12. Either throughbore may be of greater diameter than the other without affecting the operability of the structure, though preferably they are of the same cross section. A tubular mouthpiece 37 extends upwardly from the stem 31, a suitable amount as to be comfortable to the average person, usually about an inch to an inch and one half, and is of an external cross section substantially equal to the cross section of the throughbore 34. That way there is no impediment to fluid flow from within the pouch 80 seen in FIG. 1. Stem 31 preferably has a tapered upper edge 40, shown designated in FIG. 3.

Cap 33 is seen to have a recessed area 39 sized in cross section slightly larger than the mouthpiece 37 in order to receive the mouthpiece therein as is depicted in FIG. 2. While conveniently shown as being of a circular cross section bores 34, 36 and recess 39 could be square or hexagon or some other shape as may be desired. Cap 33 may have an opposite taper lower edge (lower edge when seen in the operative position of inversion). Such tapered edge is designated 42, also in FIG. 2.

Figure 3:
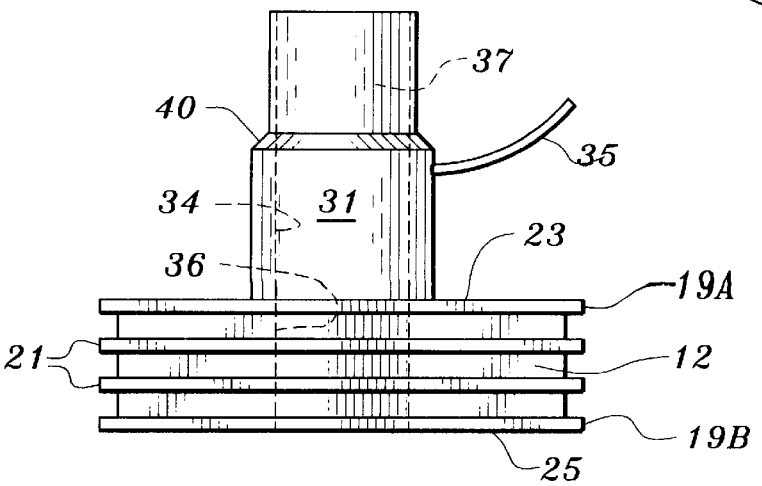
FIG. 3 is a close-up plan view of the fitment as in FIG. 1, but with the cap removed.

Whereas in FIG. 2, the mouthpiece 37 is seen in dashed lines, here in FIG. 3, it is readily seen. Mouthpiece 37 has a central bore 38, that is in fluid communication with aligned bore 34 and bore 36 of the base. These 3 bores form the path of travel from the pouch up to the mouth of the user, not seen.

Figure 4:
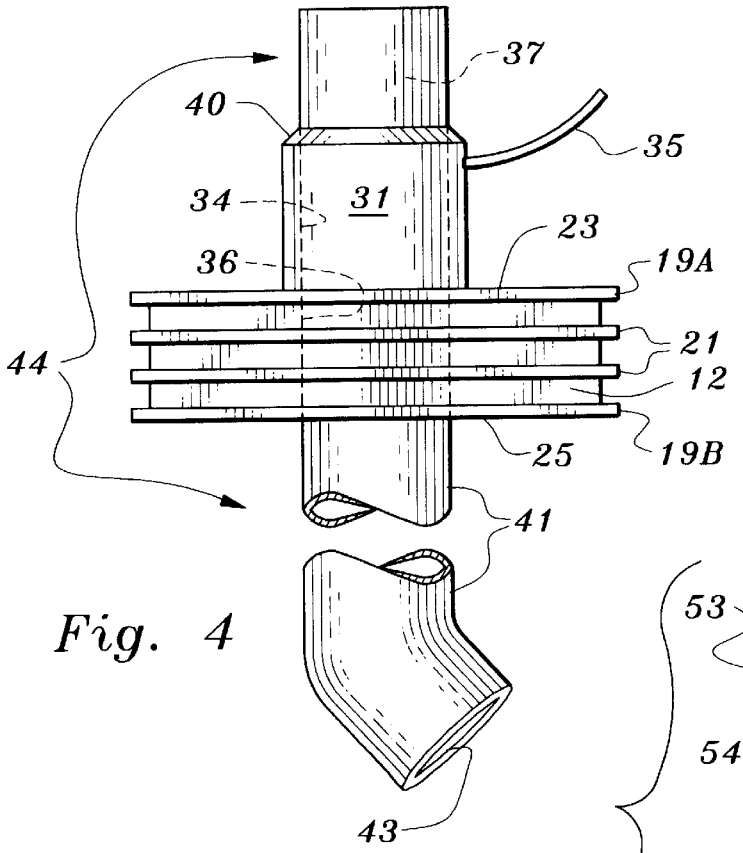
FIG. 4 is a view similar to FIG. 3 of a one piece fitment with an integrated straw attached thereto.

FIG. 4 is a view similar to FIG. 3, but for the presence of the elongated tubular member 41, the bore of which is designated 43. The combination of the mouthpiece 37 with its hole 38, the stem 31, with this bore 34, 36 the bore in the base 12, and the elongated tubular member 41 with its bore 43, all of the bores being in fluid communication, can be considered as a straw 44, a device well known in the art. In this embodiment tubular member 41 is integrally molded with and is attached to base 12, just as the stem 31 and mouthpiece are molded therewith as a one piece unit (along with cover 32 only seen in part in this view).

Figure 5:
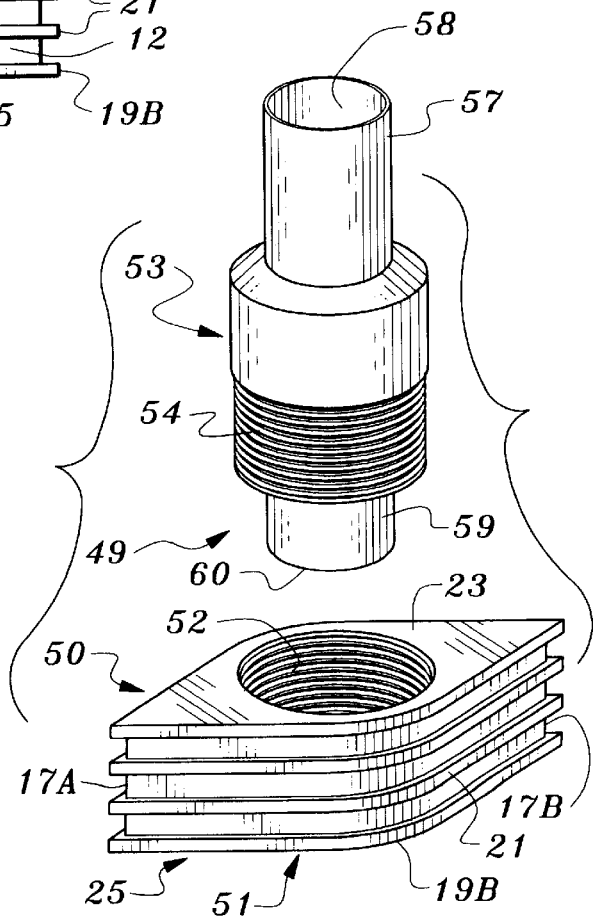
FIG. 5 is a perspective view of a second embodiment of the closure of this invention.

In order to reduce manufacturing costs as would be associated with a complex molded item as shown in FIG. 4, the closures of FIG. 5 and the variants thereof were created.

In the discussion to follow, like numbers refer to like parts or portions thereof and separate discussion will not be recited in such instances. The discussion now moves to FIG. 5 and the next embodiment; namely, closure 49.

The closure's fitment 50 is a boat shaped base, 51 having a pointed leading and trailing edge 17A, 17B, similar ribs such as 19B and 21, and two sides 13, 15, each of which extend linearly diverging a finite distance from one of the pointed edges, then arcuately and then converging linearly inward the same finite amount to the second point at the opposite end of the base 51. Base 51 also includes a threaded throughbore 52, per FIG. 7, and lower threaded zone 52'.

A circular stem 53 having a threaded lower section 54 of substantially the same cross section as the bore 52, is matingly engageable with the threaded bore 52 of the base 50. Upstanding from the stem 53 is mouthpiece 57 which is a tubular member having a throughbore 58 which is in fluid communication with the bore 56, through the stem 53, which bore is seen in FIG. 5. Mouthpiece 57 is preferably of a smaller cross section than stem 53 and of a suitable elevation as to be comfortable to the average mouth.

Extending downwardly from the threaded section of the stem 53 is an optional down tube 59 having a bore 60 in fluid communication with each of bores 58 and 56. Down tube 59 may be of the same or different cross section as the mouthpiece 57. When stem 53 is threadedly engaged into the base, the down tube 59 will extend slightly beneath the lower surface 25 of the fitment. When such an optional down tube is employed, it can serve as a means to receive a frictionally engaged elongated tubular member of a slightly greater cross section. Thus reference is made to FIG. 6 which shows the presence of an elongated tubular member 61 with its bore 62. While shown as a friction slide on fit, it is also seen that one or more outwardly extending encircling ribs could also be put on the down tube over which the elongated tubular member would be stretched tightly to ensure a long lasting fit. For ease of understanding, no cover and handle are seen present in FIG. 6. Such a cover, if present, would be similar to the one discussed with respect to FIGS. 1 and 2.

Figure 8:
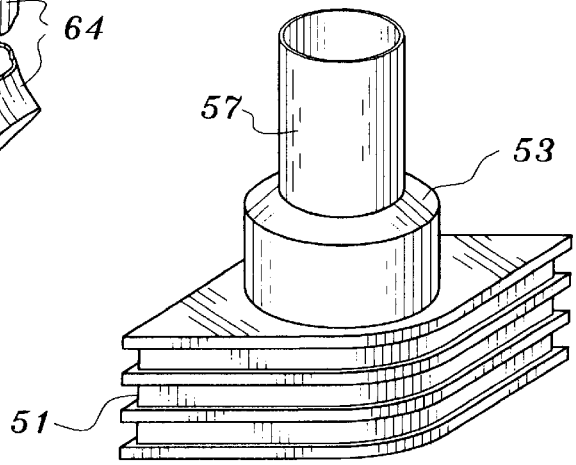
FIG. 8 is a top perspective view showing the two pieces of the closure engaged.

FIG. 8 illustrates the assembled exploded closure of FIG. 5, showing stem 53 with its associated mouthpiece screwed into the base 51. Throughbore 52 is only partially threaded.

Figure 7:
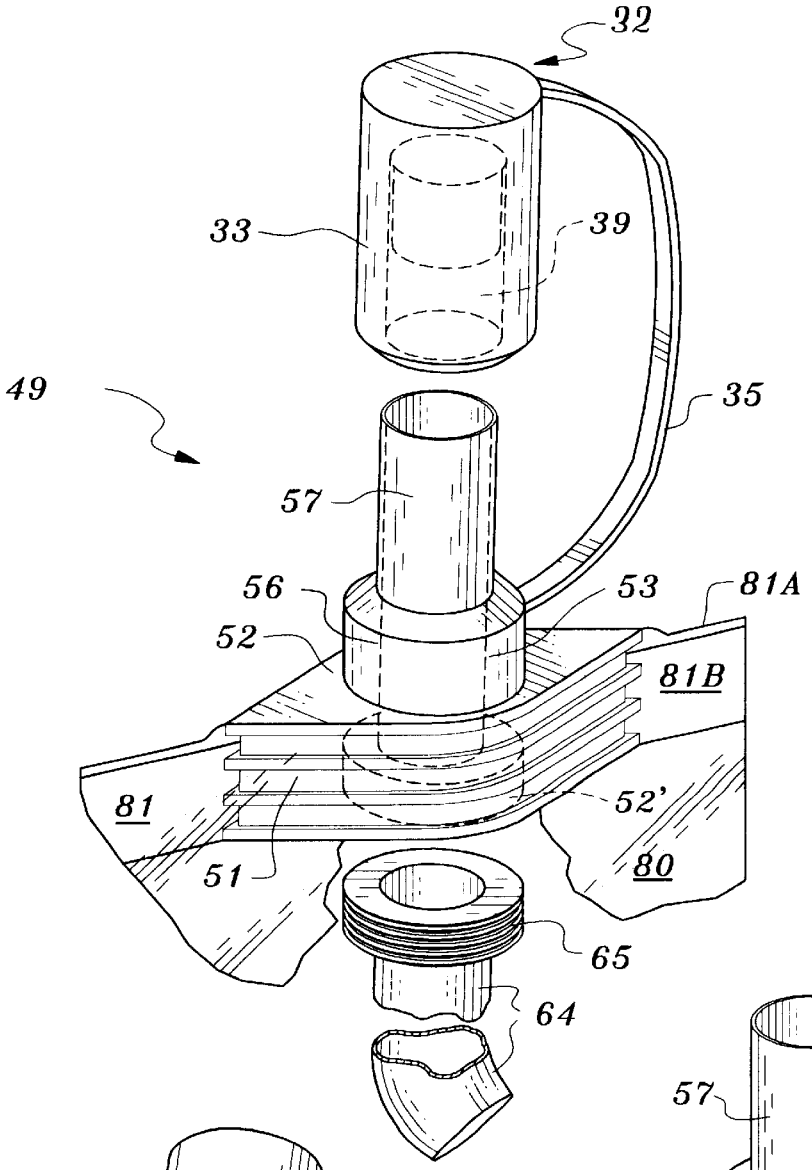
FIG. 7 is a perspective view of a clear pouch with the fitment of FIG. 4 shown horizontally disposed at a corner of the pouch, with the cap removed from the mouthpiece, and the integrated straw disposed downwardly from the fitment.
Figure 9:
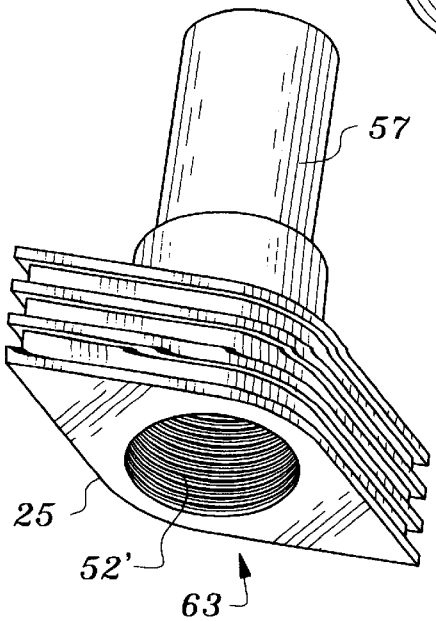
FIG. 9 is a bottom plan view of the closure shown in FIG. 8.

In FIG. 9 a variant of this second embodiment is seen while the stem 53 threads into the base 51, no down tube 59 is present on the underside of the stem. Instead, the internal threads 52" are continued downwardly to the lower opening 63 on the lower surface 25 of the base 51. This permits a threaded elongated tubular member 64 having reversed threads 65 to be threadingly engaged into threads 52' such that elongated tubular member 64 can depend downwardly into a juice or other liquid laden pouch, a portion of which is seen in FIG. 7.

While in the embodiment of FIGS. 1, 2, and 3, the interface edge of the cover and the mouthpiece both included optional tapered edges, such have not been shown in the embodiment wherein the stem threads into the base. Such tapered edges are however within the scope of this embodiment as well. Handle 35 and cover 32 are the same as previously disclosed with respect to FIGS. 1 and 2. Thus the recess designated the mouthpiece receiver 39 within the cap 33 of the cover is present here as well. Handle 35 is shown in a taut position to illustrate the separation of the cap from the mouthpiece. Designator 80 is to show the environment of the pouch for the closure of this invention. As mentioned earlier edges 81 are heat sealed together or sonically welded to the fitment base 51 of this embodiment. See FIG. 7. The reader's attention is also turned to FIG. 9 which shows the threads 52' for the threaded elongated tubular member just discussed with respect to FIG. 7.

Figure 10:
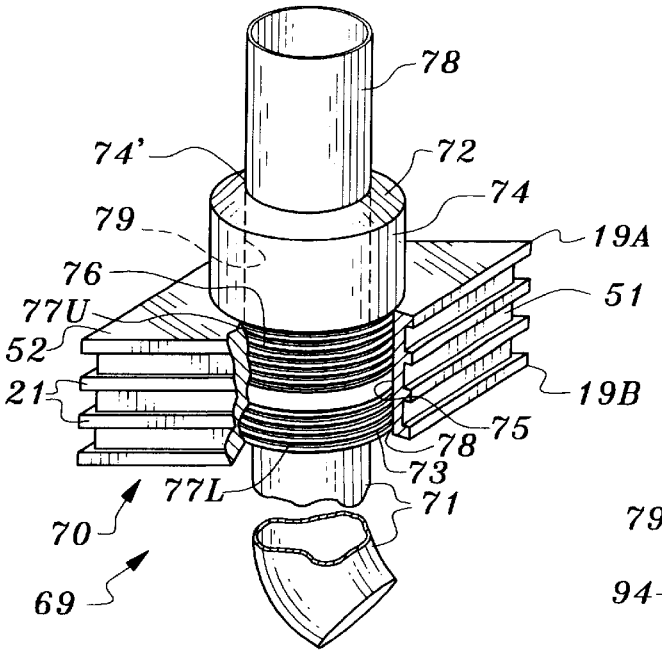
FIG. 10 is a perspective view, partially cutaway, of a three piece closure consisting of a fitment and a removably insertable stem carrying a separate straw.

The discussion now moves to FIG. 10. It is seen that the closure of this embodiment has three elements; namely, a base 51,a straw 71 and a removable stem 74 with no mouthpiece on the stem. The closure (69)'s fitment 70 in FIG. 10 has a base 51 similar to the base 51 previously discussed relative to FIGS. 8 and 9. Here, however, in this embodiment, the stem is not stem 53 but stem 74 in that the mouthpiece is not integrated into the stem. The stem 74 has a throughbore 75, centrally located to receive straw 71. Stem 74 is annular shaped in a first section above the top surface of the base and carries a downwardly depending tubular section 75, which carries external threads 76 engageable with upper threads 77U of the bore 78 through the base 51. Upper threads 77U has a greater cross section than the lower threads 77L of the opening 78 through the base. Straw 71 is disposed through the tubular section 75 and the opening 79 in the first section 74' of the stem 74. A portion 78 of straw 71, extends upward above the stem and the balance of the straw 71 extends downward beneath the base 51 into a pouch not seen in this view. Straw 71 is inserted through the top surface of stem 74 and carries exterior threads 73, at a suitable location to be engageable with lower threads 77L of the base. The threads 77L are of a smaller cross section than upper threads 77U. Thus the straw is top insertable and is threaded into the threads 77L. A stop or shoulder 72 is carried on the straw 71 to ensure that the straw is not overly threaded into the threads 77L such as to pass through the base 51. This shoulder 72 is of a cross section such that it will not pass through opening 75 of the stem 74.

Figure 11:
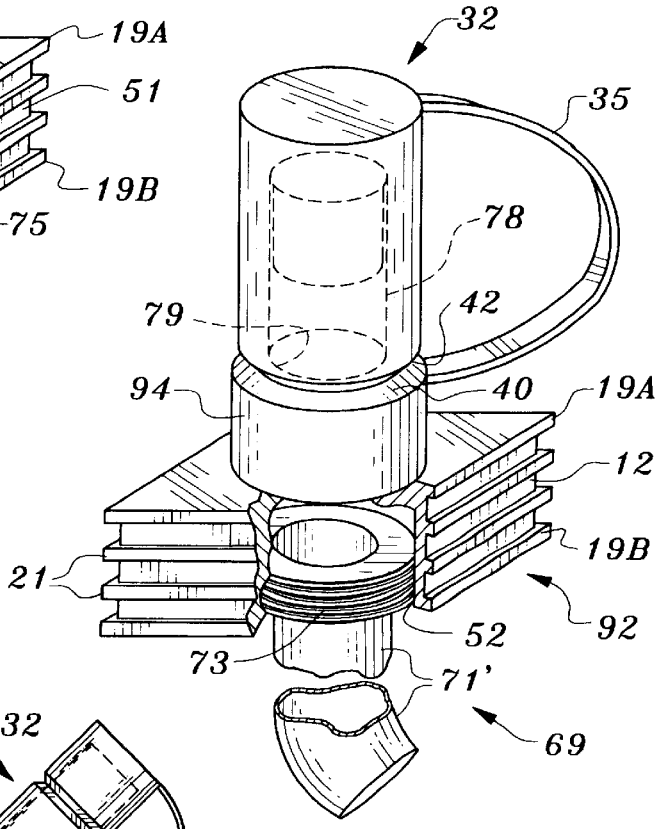
FIG. 11 is a perspective view, also partially cutaway, of another two piece closure consisting of a fixed stem in a base, and a threadably engageable straw.

In the next embodiment shown in FIG. 11, the base is designated 12 and is similar to the one found in FIG. 4 in that the stem is integrated thereon, but since the stem does NOT include a mouthpiece, it is designated 91 instead of 31. The handle 35 and cover 32 as seen here are of like numbers to elements previously discussed and no further discussion is needed here, other than to indicate that the handle attaches in like manner to the stem as previously discussed. That is, preferably through integral molding as a one piece part. The straw here is designated 71' to distinguish it slightly from straw 71 of the previous embodiment. Here external threads 73 carried by the straw 71' engage the internal threads 77 of the base 12. Portion 78 of the straw 71' projects through the opening 79 of the top surface of this stem 94, while the balance of the straw extends downwardly beneath the stem 12 as is depicted. Note also the presence of the tapered edges 42 and 40 for a more aesthetic look, similar to those found in the FIG. 2 embodiment.

From a manufacturing point of view the embodiment of FIG. 11 is cheaper to make than the embodiment of FIG. 10. But the tradeoff is that by having the stem removable in FIG. 10's embodiment, the pouch is more readily refillable when the original supply of fluid is exhausted.

Figure 12:
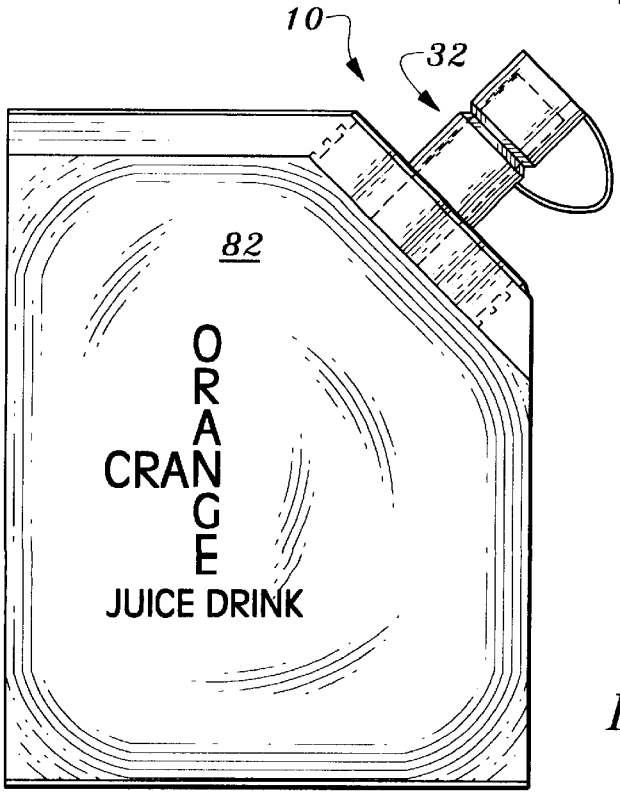
FIG. 12 shows an angular disposition of a closure according to this invention, which closure is without a straw.

FIG. 12 is a perspective view to illustrate one placement of any of the embodiments of this invention shown mounted in a pouch at one corner. The base of the fitment would be heat sealed at this location in the same manner as the base is shown sealed into place in the pouch shown in FIG. 7. In this view no straw or down tube is seen, thus requiring the user to raise the pouch toward the sky to access the very last drops of fluid therein.

Figure 13:
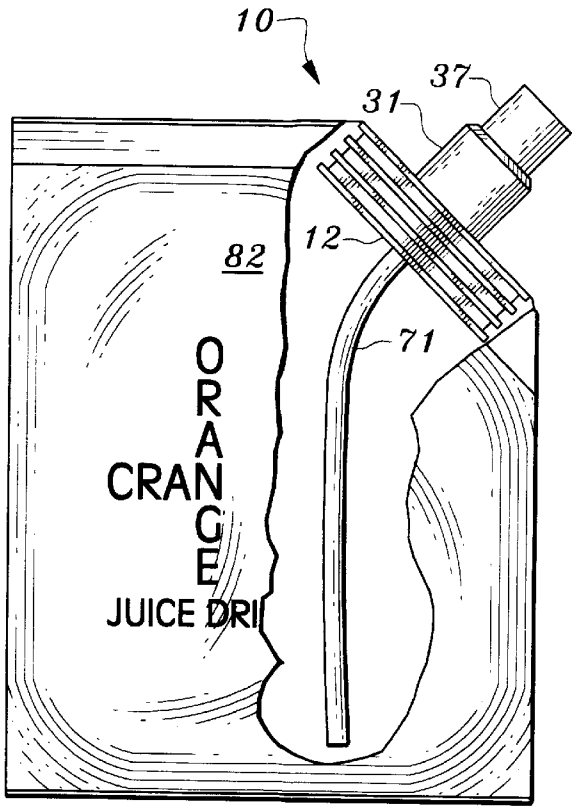
FIG. 13 is a cutaway view showing an angularly disposed closure according to the invention with a straw.

FIG. 13 illustrates a corner disposition of the closure according to this invention, with the straw disposed within the pouch. The cover is not seen in this view for ease and convenience. By having a straw or some type of downwardly extending member as previously discussed, the user need not raise the unit as high in the air to access the remnants of the contents. There is less chance for swallowing too big a gulp this way than in the embodiments having only a mouthpiece and no below the base member.

Figure 6:
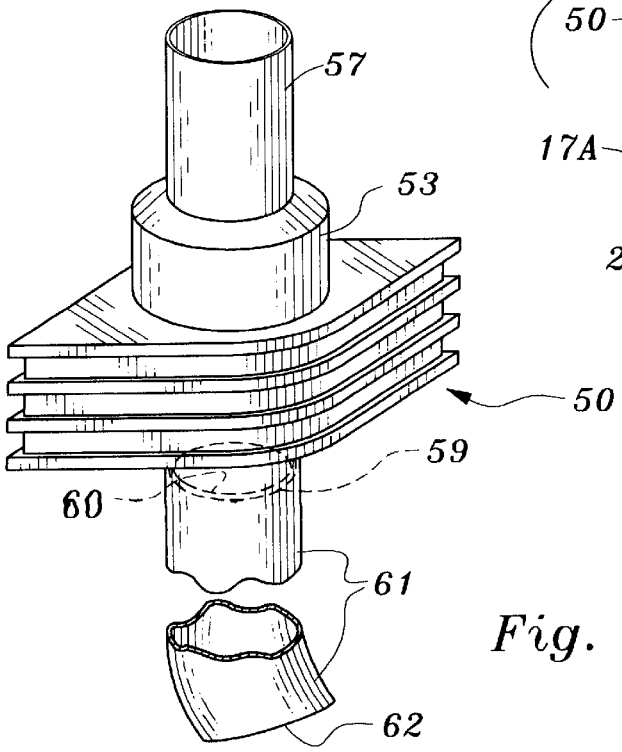
FIG. 6 is a variant of the fitment of FIG. 1 wherein the mouthpiece is replaced by a straw that carries a stopper member and which straw passes through the fitment.

Let us return momentarily to FIG. 7. While the discussion of that figure was based upon the use of a threaded stem 53, it is equally important to understand, that a variant of the feature of a threadable elongated tubular member dependent from the base 51, can be readily achieved where the stem is integrally formed with the base 51. The same is true for an embodiment utilizing the frictionally engageable elongated tubular member 61 to fit over the down tube 59. FIG. 6 as depicted would support such a structure since the threaded engagement of stem to base is not visible. And FIG. 7 would support the structure of an integrated stem for the same reason.

Figure 14:
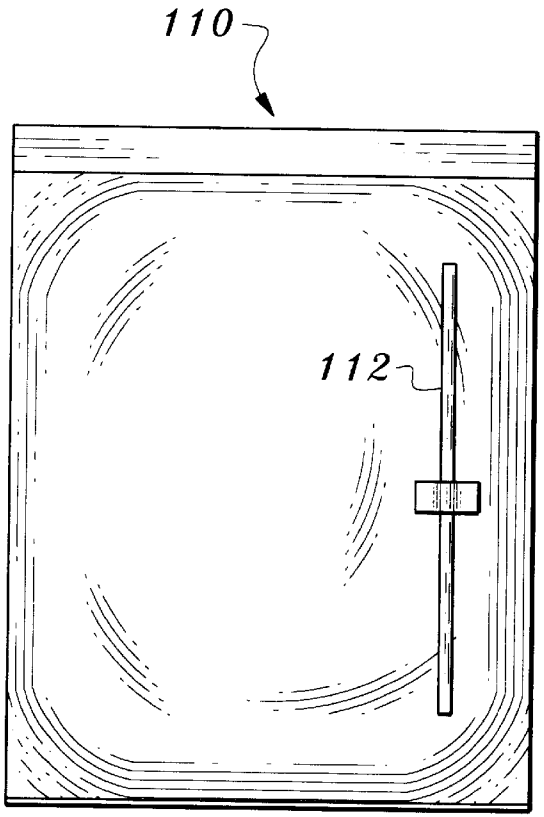
Fig. 14 (PRIOR ART)
FIG. 14 is a rear elevational view of a prior art pouch with a straw externally mounted thereon. (PRIOR ART).
Figure 15:
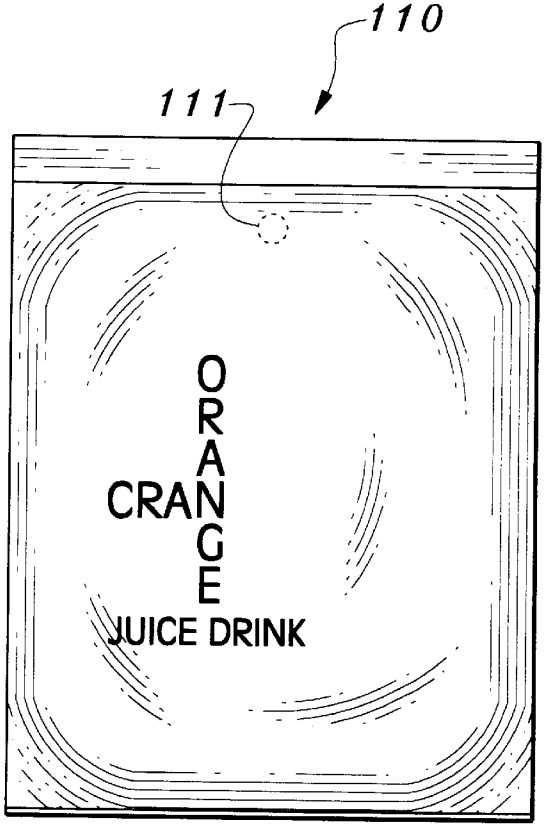
Fig. 15 (PRIOR ART)
FIG. 15 is a front elevational view thereof, (PRIOR ART).

It is seen that my invention represents a significant improvement over the prior art unit pouch 110 shown in FIGS. 14 and 15. The little opening 111 sometimes can not be punctured by the straw 112 seen on the other side of this pouch, and the straw sometimes separates from the pouch. None of these problems can happen with any of the embodiments of my invention.

It is within the skill of the engineer of the packaging art to provide a tamperproof seal for the closures of this invention, to prevent the cap of the cover from being lifted for surreptitious purposes by non-purchasers. For example threads may be made to engage one way only, or a breakaway member such as pull tab 99 of FIG. 2 may be employed to prevent unwanted access to the container. Such pull tabs 99, which can utilize minute serrations such as 99*on a plastic strip to effectuate the separation of the tab from the remnant are known to the art from their use as a contaminant preventative measure for one half gallon plastic milk containers. Another mode, not illustrated, is to cover over the entire stem and cap with a thin plastic self-supporting film.

Since certain changes may be made in the above described apparatus without departing from the scope of the invention herein involved, it is intended that all matter contained in the above description and in the accompanying drawings, if present, shall be interpreted as illustrative only and not in a limiting sense.

I claim:

1. A closure (49) for a self-supporting stand-up pouch (80) for drinks for human consumption and other fluids which pouch is formed of two sealable members, (81, 82) and which closure (49) comprises:

(A) a fitment (50) having a boat shaped base (51), which base (51) has an upper surface (23) and a lower surface (25), and two sides (13, 15) and a series of ribs (19A, 19B, 21) extending outward from the two sides, the first of said ribs (19A) being disposed outwardly from the upper surface, the second of said ribs (21) being disposed outwardly from the lower surface thereof, the balance of the series being disposed intermediate the first and second of said ribs;

said base (12) having a threaded throughbore (52) that communicates between the upper surface (23) and the lower surface (25);

(B) a stem (53) having a throughbore (56)and a threaded lower section (54) threadedly engageable to the threads (52) of said fitment (51), said stem (53) threaded lower section (54) being of substantially the same cross section as the bore (52) of said fitment, and a non-threaded upper section, which upper section has a mouthpiece of a smaller cross section extending upwardly therefrom in fluid communication with the throughbore (56) of said stem, and which lower section of said stem includes a downtube (59) having a bore (60) also in fluid communication with throughbore (56), said stem (53) also being closed off by, (C) a removable cover (32) in fluid communication with the throughbore of said stem (53).

2. In the closure of claim 1, wherein the tubular mouthpiece is of a cross-section lesser than the cross-section of said stem.

3. In the closure of claim 2, wherein a downtube (59) is disposed downwardly from the threads (54) of said stem (53) which downtube (59) is of a lesser cross-section than the threaded throughbore (52).

4. In the closure of claim 1, wherein a downtube (59) is disposed downwardly from the threads (54) of said stem (53) which downtube (59) is of a lesser cross-section than the threaded throughbore (52).

5. In the closure of claim 1, wherein the removable cover (32) comprises a cap (33) and a flexible handle (35), said handle (35) being attached to said stem (53) and said cap (33).

6. A closure (49) for a self-supporting stand-up pouch (80) for drinks for human consumption and other fluids which pouch is formed of two sealable members, (81, 82) and which closure (49) comprises:

(A) a fitment (50) having a boat shaped base (51), which base (51) has an upper surface (23) and a lower surface (25), and two sides (13, 15) and a series of ribs (19A, 19B, 21) extending outward from the two sides, the first of said ribs (19A) being disposed outwardly from the upper surface, the second of said ribs (21) being disposed outwardly from the lower surface thereof, the balance of the series being disposed intermediate the first and second of said ribs;

said base (12) having a threaded throughbore (52) that communicates between the upper surface (23) and the lower surface (25);

(B) a stem (53) having a throughbore (56), which stem (53) is integrally mounted in fluid communication with the threaded throughbore (52) of the base (51), said stem (53) also being integrally connected to (C) a tubular mouthpiece (57) of a lesser cross section than said stem and which mouthpiece extends upwardly from said stem (53) in fluid communication with the throughbore of said stem (53).

7. In the closure of claim 6 further including (D) a removable cover.

8. In the closure of claim 6, wherein the tubular mouthpiece is of a cross-section lesser than the cross-section of said stem.

9. In the closure of claim 8, wherein a downtube (59) is disposed downwardly from the threads (54) of said stem (53) which downtube (59) is of a lesser cross-section than the threaded throughbore (52).

10. In the closure of claim 6 wherein a downtube (59) is disposed downwardly from the threads (54) of said stem (53) which downtube (59) is of a lesser cross-section than the threaded throughbore (52).

11. In the closure of claim 6, wherein the removable cover (32) comprises a cap (33) and a flexible handle (35), said handle (35) being attached to said stem (53) and said cap (33).

12. In combination, a self-supporting fluid containable heat sealable stand-up pouch, (80) and the closure (49) for a self-supporting stand-up pouch (80) for drinks for human consumption and other fluids which pouch is formed of two sealable members,(81, 82) and which closure (49) comprises:

(A) a fitment (50) having a boat shaped base (51), which base (51) has an upper surface (23) and a lower surface (25), and two sides (13, 15) and a series of ribs (19A, 19B, 21) extending outward from the two sides, the first of said ribs (19A) being disposed outwardly from the upper surface, the second of said ribs (21) being disposed outwardly from the lower surface thereof the balance of the series being disposed intermediate the first and second of said ribs, said base (12) having a threaded throughbore (52) that communicates between the upper surface (23) and the lower surface (25);

(B) a stem (53) having a throughbore (56)and a threaded lower section (54) threadedly engageable to the threads (52) of said fitment (51), said stem (53) threaded lower section (54) being of substantially the same cross section as the bore (52) of said fitment, and a non-threaded upper section, which upper section has a mouthpiece of a smaller cross section extending upwardly therefrom in fluid communication with the throughbore (56) of said stem, and which lower section of said stem includes a downtube (59) having a bore (60) also in fluid communication with throughbore (56), said stem (53) also being closed off by, (C) a removable cover (32)

said fitment being heat sealed within said heat sealable standup pouch from the lower most of said ribs to the upper most of said ribs.

13. In the combination of claim 12 wherein the non-threaded upper section has a tapered upper edge that intersects said mouthpiece.

14. In combination, a self-supporting fluid containable heat sealable stand-up pouch, (80) and the closure (49) for a self-supporting stand-up pouch (80) for drinks for human consumption and other fluids which pouch is formed of two sealable members,(81, 82) and which closure (49) comprises:

(A) a fitment (50) having a boat shaped base (51), which base (51) has an upper surface (23) and a lower surface (25), and two sides (13, 15) and a series of ribs (19A, 19B, 21) extending outward from the two sides, the first of said ribs (19A) being disposed outwardly from the upper surface, the second of said ribs (21) being disposed outwardly from the lower surface thereof, the balance of the series being disposed intermediate the first and second of said ribs, said base (12) having a threaded throughbore (52) that communicates between the upper surface (23) and the lower surface (25);

(B) a stem (53) having a throughbore (56) and a threaded lower section (54) threadedly engageable to the threads

(52) of said fitment (51), said stem (53) threaded lower section (54) being of substantially the same cross section as the bore (52) of said fitment, and a non-threaded upper section, which upper section has a mouthpiece of a smaller cross section extending upwardly therefrom in fluid communication with the throughbore (56) of said stem, said stem (53) also being closed off by, (C) a removable cover (32)

said fitment being heat sealed within said heat sealable standup pouch from the lower most of said ribs to the upper most of said ribs.

15. A closure (49) for a self-supporting stand-up pouch (80) for drinks for human consumption and other fluids which pouch is formed of two sealable members, (81, 82) and which closure (49) comprises:

(A) a fitment (50) having a boat shaped base (51), which base (51) has an upper surface (23) and a lower surface (25), and two sides (13, 15) and a series of ribs (19A, 19B, 21) extending outward from the two sides, the first of said ribs (19A) being disposed outwardly from the upper surface, the second of said ribs (21) being disposed outwardly from the lower surface thereof, the balance of the series being disposed intermediate the first and second of said ribs;

said base (12) having a threaded throughbore (52) that communicates between the upper surface (23) and the lower surface (25);

(B) a stem (53) having a throughbore (56)and a threaded lower section (54) threadedly engageable to the threads (52) of said fitment (51), said stem (53) threaded lower section (54) being of substantially the same cross section as the bore (52) of said fitment, and a non-threaded upper section, which upper section has a mouthpiece of a smaller cross section extending upwardly therefrom in fluid communication with the throughbore (56) of said stem, and which lower section of said stem, said stem (53) also being closed off by, (C) a removable cover (32) in fluid communication with the throughbore of said stem (53).

16. In combination, a self-supporting fluid containable heat sealable stand-up pouch, (80) and the closure (49) for a self-supporting stand-up pouch (80) for drinks for human consumption and other fluids which pouch is formed of two sealable members,(81, 82) and which closure (49) comprises:

(A) a fitment (50) having a boat shaped base (51), which base (51) has an upper surface (23) and a lower surface (25), and two sides (13, 15) and a series of ribs (19A, 19B, 21) extending outward from the two sides, the first of said ribs (19A) being disposed outwardly from the upper surface, the second of said ribs (21) being disposed outwardly from the lower surface thereof, the balance of the series being disposed intermediate the first and second of said ribs, said base (12) having a threaded throughbore (52) that communicates between the upper surface (23) and the lower surface (25);

(B) a stem (53) having a throughbore (56)and a threaded lower section (54) threadedly engageable to the threads (52) of said fitment (51), said stem (53) threaded lower section (54) of substantially the same cross section as the bore (52) of said fitment, and a nonthreaded upper section, which upper section has a mouthpiece of a smaller cross section extending upwardly therefrom in fluid communication with the throughbore (56) of said stem, and which lower section of said stem, said stem (53) also being closed off by, (C) a removable cover (32)

said fitment being heat sealed within said heat sealable standup pouch from the lower most of said ribs to the upper most of said ribs.

17. In combination, a self-supporting fluid containable heat sealable stand-up pouch, (80) and the closure (49) for a self-supporting stand-up pouch (80) for drinks for human consumption and other fluids which pouch is formed of two sealable members, (81, 82) and which closure (49) comprises:

(A) a fitment (70) having a boat shaped base (51), which base (51) has two sides (13, 15) and a series of ribs (19A, 19B, 21) extending outward from the two sides, the first of said ribs (19A) being disposed outwardly from the upper surface, the second of said ribs (21) being disposed outwardly from the lower surface thereof, the balance of the series being disposed intermediate the first and second of said ribs;

said base (51) having a threaded throughbore (52);

(B) a stem (53) having a throughbore (56) in an annular section thereof, threadedly engageable to the threaded throughbore of base (51) by threads (54) carried by a downwardly extending tubular section of said stem (53), said stem also being closed off by, (C) a tubular mouthpiece (57) of a lesser cross-section than said stem (53) extending upwardly from said stem (53); and a (D) a removable cover disposed on said mouthpiece.

18. The combination of claim 17 wherein the removable cover is removably attached to said stem (53).

19. In the combination of claim 17 wherein a downtube (59) is disposed downwardly from the threads (54) of said stem (53) which downtube (59) is of a lesser cross-section than the threaded throughbore (52).

* * * * *